US008016625B2

(12) United States Patent
Suzuki et al.

(10) Patent No.: US 8,016,625 B2
(45) **Date of Patent: *Sep. 13, 2011**

(54) MARINE PROPULSION SYSTEM

(75) Inventors: Takayoshi Suzuki, Shizuoka (JP); Daisuke Nakamura, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 127 days.

This patent is subject to a terminal disclaimer.

(21) Appl. No.: 12/393,085

(22) Filed: Feb. 26, 2009

(65) Prior Publication Data

US 2009/0215338 A1 Aug. 27, 2009

(30) Foreign Application Priority Data

Feb. 27, 2008 (JP) ..... 2008-046615

(51) Int. Cl.
*B63H 21/22* (2006.01)
*B63H 23/00* (2006.01)

(52) U.S. Cl. ..... 440/1

(58) Field of Classification Search ..... 440/1, 49, 440/53, 75, 80, 81, 84, 86, 87
See application file for complete search history.

(56) References Cited

U.S. PATENT DOCUMENTS 6,884,128 B2 * 4/2005 Okuyama et al. ..... 440/1
6,994,046 B2 * 2/2006 Kaji et al. ..... 114/144 R
7,769,504 B2 * 8/2010 Kaji ..... 701/21
2006/0213301 A1 9/2006 Mizuguchi et al.

FOREIGN PATENT DOCUMENTS

JP 2006-264361 A 10/2006

* cited by examiner

*Primary Examiner* — Daniel Venne
(74) *Attorney, Agent, or Firm* — Keating & Bennett, LLP

(57) ABSTRACT

A marine propulsion system includes a power source, a propeller, a shift mechanism, a control lever, a rotational speed sensor, and a control device. The shift mechanism is switchable among three shift positions including forward, neutral, and reverse. The control lever is operable by the marine vessel operator to switch the shift position of the shift mechanism. The rotational speed sensor detects the rotational speed of the propeller. The control device controls at least one of the power source and the shift mechanism so as to reduce the rotational speed of the propeller if the rotational speed sensor detects a rotational speed of the propeller when the control lever is in a position corresponding to the neutral shift position. As a result, the propeller is prevented from rotating when a control lever is in a neutral position.

9 Claims, 10 Drawing Sheets

| Name of component (reference numeral) | ○ : Clutch engaged state × :Clutch disengaged state | | | | |
|---|---|---|---|---|---|
| Transmission ratio switching hydraulic clutch (53) | × | ○ | × (○) | × | ○ |
| Second shift switching hydraulic clutch (61) | × | × | × | ○ | ○ |
| First shift switching hydraulic clutch (62) | ○ | ○ | × | × | × |
| One-way clutch (58) | Prevents reverse rotation | Permits normal rotation | Inoperative | Prevents reverse rotation | Permits normal rotation |
| Shift position | Low-speed forward | High-speed forward | Neutral | Low-speed reverse | High-speed reverse |

FIG. 6

MARINE PROPULSION SYSTEM

BACKGROUND OF THE INVENTION

1. Field of the Invention

The present invention relates to a marine propulsion system.

2. Description of the Related Art

A technique for switching the shift position of an outboard motor by driving a shift mechanism of the outboard motor with an electric actuator has been suggested as described in, for example, JP-A-2006-264361. In the shift mechanism described in JP-A-2006-264361, the dog clutch is engaged or disengaged with the electric actuator to achieve a shift position change among forward, reverse, and neutral.

Typically, the inside of the dog clutch is filled with oil. Thus, when the viscosity of the oil is very high in, for example, a very low temperature environment, the output shaft of the dog clutch may rotate in conjunction with rotation of the input shaft even if the dog clutch is disengaged. Therefore, in the vessel disclosed in JP-A-2006-264361, for example, the propeller may rotate and produce a propulsive force even when the control lever is in a neutral position corresponding to the neutral shift position.

SUMMARY OF THE INVENTION

In order to overcome the problems described above, preferred embodiments of the present invention prevent a propeller from rotating when the control lever is in the neutral position.

A marine propulsion system according to a preferred embodiment of the present invention includes a power source, a propeller, a shift mechanism, a control lever, a rotational speed sensor, and a control device. The propeller is drivable by the power source. The shift mechanism is located between the power source and the propeller. The shift mechanism is switchable among three shift positions including forward, neutral, and reverse. The control lever is operable by a marine vessel operator to switch the shift position of the shift mechanism. The rotational speed sensor detects a rotational speed of the propeller. The control device controls at least one of the power source and the shift mechanism so as to reduce the rotational speed of the propeller if the rotational speed sensor detects a rotational speed of the propeller when the control lever is in a position corresponding to the neutral shift position.

According to a preferred embodiment of the present invention, the propeller can be prevented from rotating when the control lever is in a position corresponding to the neutral shift position.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIG. 6 is a table showing the engagement states of the first to third hydraulic clutches and the shift positions of the shift mechanism.

DETAILED DESCRIPTION OF THE PREFERRED EMBODIMENTS

Description is hereinafter provided of preferred embodiments of the present invention using an outboard motor 20 shown in FIG. 1 as a marine propulsion system as an example. It should be noted that the following preferred embodiments are merely examples of the preferred form of the present invention. The present invention is not limited to the following preferred embodiments. A marine propulsion system according to a preferred embodiment of the present invention may be what is called an inboard motor or what is called a stern drive. Stern drives are also called "inboard-outboard motors." A "stern drive" is a marine propulsion system at least the power source of which is mounted on a hull. "Stern drives" include engines also having components mounted on a hull other than the propulsion unit.

Figure 1:
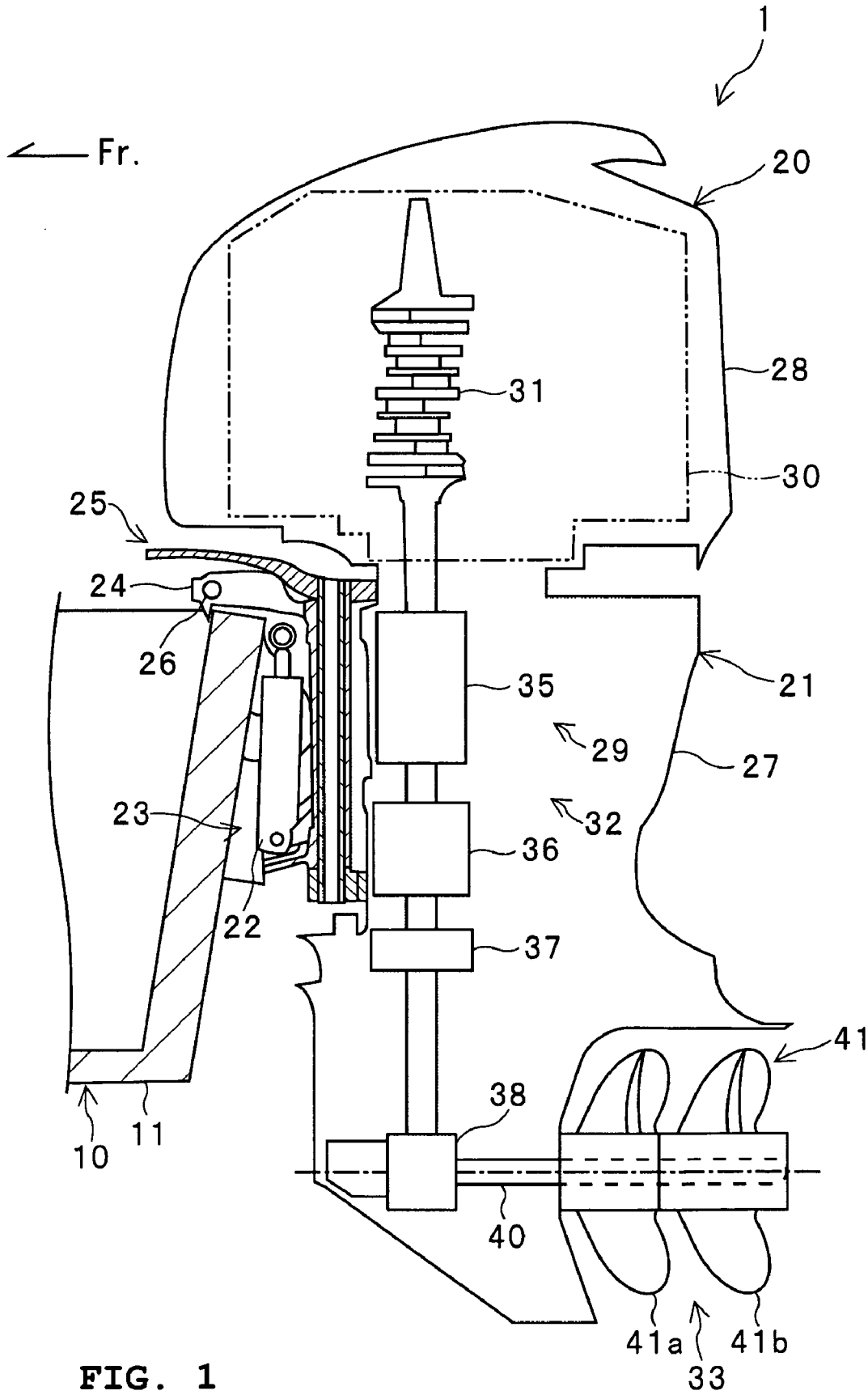
FIG. 1 is a partial cross-sectional view, as seen from one side, of a portion of the stern of a vessel according to a first preferred embodiment of the present invention.

FIG. 1 is a schematic partial cross-sectional view, as seen from a side, of a portion of the stern 11 of a vessel 1 according to the present preferred embodiment. As shown in FIG. 1, the vessel 1 has a hull 10 and the outboard motor 20. The outboard motor 20 is attached to the stern 11 of the hull 10.

Outline of Configuration of Outboard Motor 20

The outboard motor 20 has an outboard motor body 21, a tilt-trim mechanism 22, and a bracket 23.

The bracket 23 has a mount bracket 24 and a swivel bracket 25. The mount bracket 24 is secured to the hull 10. The swivel bracket 25 is swingable about a pivot shaft 26 relative to the mount bracket 24.

The tilt-trim mechanism 22 is used to tilt and trim the outboard motor body 21. Specifically, the tilt-trim mechanism 22 is used to swing the swivel bracket 25 relative to the mount bracket 24.

The outboard motor body 21 has a casing 27, a cowling 28, and a propulsive force generating device 29. The propulsive force generating device 29 is disposed in the casing 27 and the cowling 28 except for a portion of a propulsion unit 33, which is described later.

Figure 2:
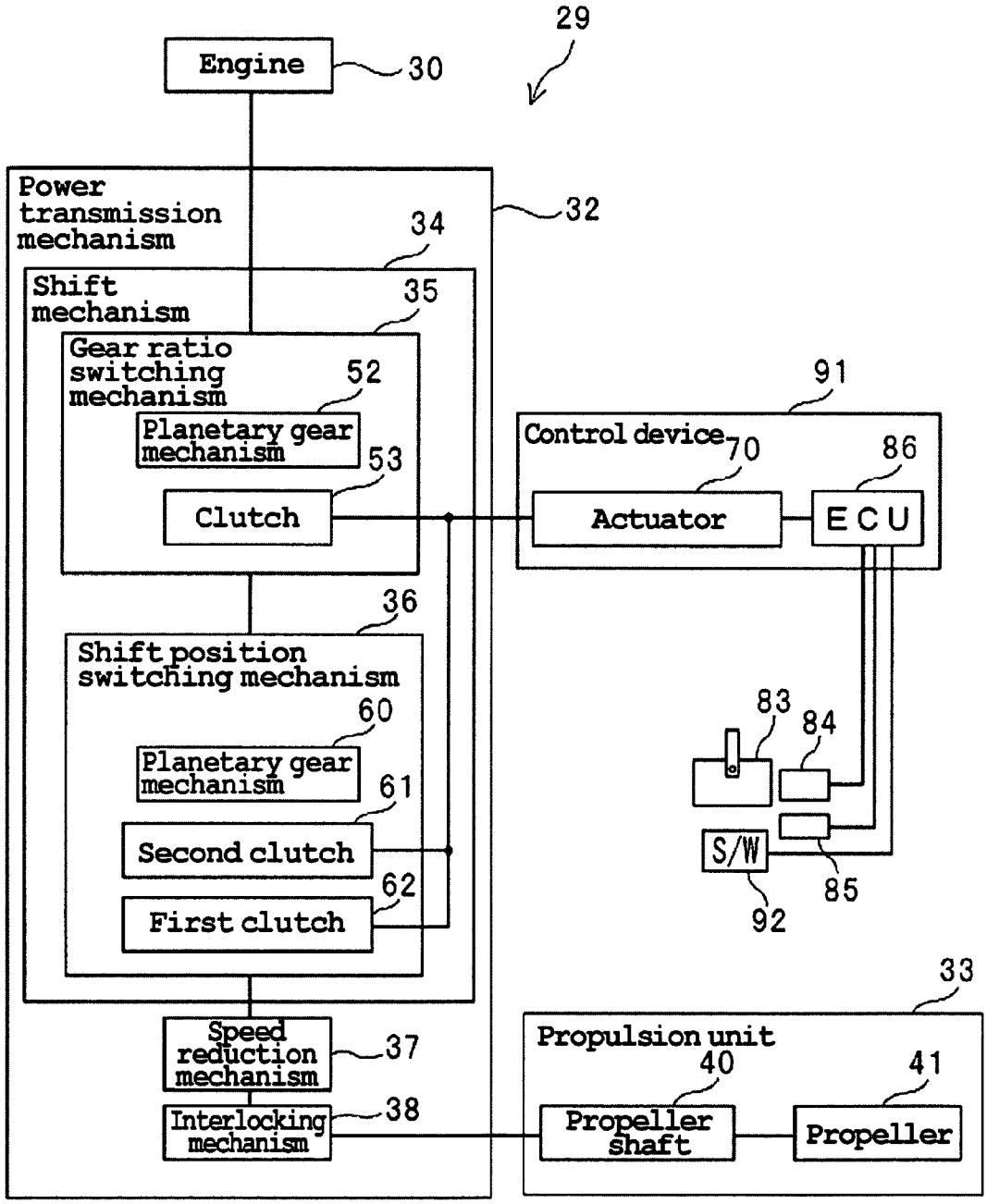
FIG. 2 is a schematic configuration diagram illustrating the configuration of a propulsive force generating device in the first preferred embodiment of the present invention.

As shown in FIG. 1 and FIG. 2, the propulsive force generating device 29 has an engine 30, a power transmission mechanism 32, and a propulsion unit 33.

In this preferred embodiment, an example in which the outboard motor 20 has an engine 30 as a power source is described. However, the power source is not particularly limited as long as it can generate rotary force. For example, the power source may be an electric motor.

Figure 5:
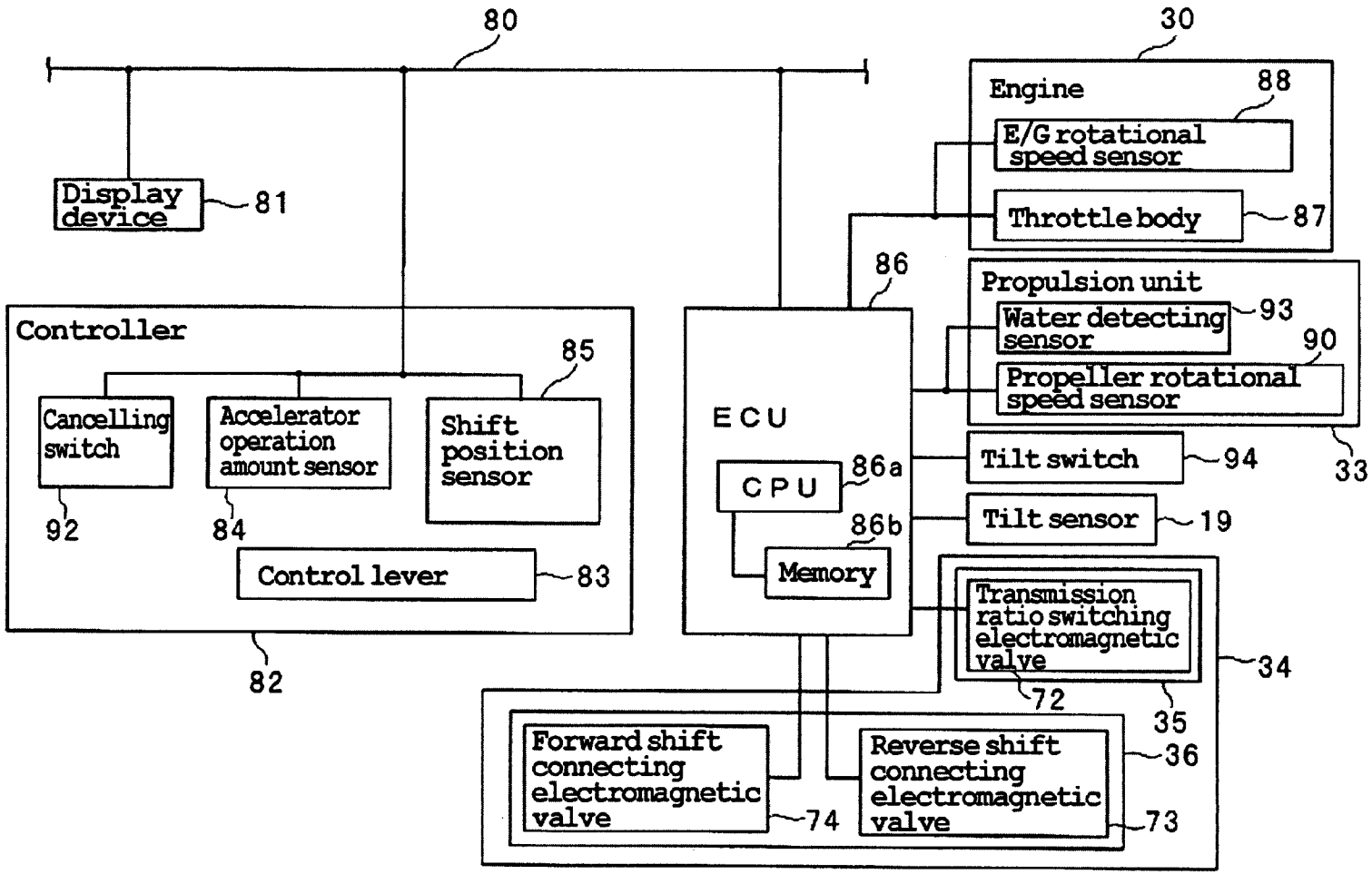
FIG. 5 is a control block diagram of the vessel.

The engine 30 preferably is a fuel injection engine having a throttle body 87 as shown in FIG. 5. In the engine 30, the engine rotational speed and the engine output are adjusted by adjusting the throttle opening. The engine 30 generates rotary force. As shown in FIG. 1, the engine 30 has a crankshaft 31. The engine 30 outputs the generated rotary force through the crankshaft 31.

The power transmission mechanism 32 is located between the engine 30 and the propulsion unit 33. The power transmission mechanism 32 transmits the rotary force generated by the engine 30 to the propulsion unit 33. The power transmission mechanism 32 preferably includes a shift mechanism 34, a speed reduction mechanism 37, and an interlocking mechanism 38.

The shift mechanism 34 is connected to the crankshaft 31 of the engine 30. As shown in FIG. 2, the shift mechanism 34 has a transmission ratio switching mechanism 35, and a shift position switching mechanism 36.

The transmission ratio switching mechanism 35 switches the transmission ratio between the engine 30 and the propulsion unit 33 between a high-speed transmission ratio (HIGH) and a low-speed transmission ratio (LOW). Here, the "high-speed transmission ratio" means a ratio of the output rotational speed to the input rotational speed which is relatively large. On the other hand, the "low-speed transmission ratio" means a ratio of the output rotational speed to the input rotational speed which is relatively small.

The shift position switching mechanism 36 is switchable among three shift positions: forward, reverse, and neutral.

The speed reduction mechanism 37 is located between the shift mechanism 34 and the propulsion unit 33. The speed reduction mechanism 37 transmits the rotary force from the shift mechanism 34 to the propulsion unit 33 at a reduced rotational speed. The structure of the speed reduction mechanism 37 is not particularly limited. The speed reduction mechanism 37 may be a mechanism having a planetary gear mechanism. Also, the speed reduction mechanism 37 may be a mechanism having a reduction gear pair.

The interlocking mechanism 38 is located between the speed reduction mechanism 37 and the propulsion unit 33. The interlocking mechanism 38 has a bevel gear set (not shown). The interlocking mechanism 38 changes the direction the rotary force from the speed reduction mechanism 37 and transmits it to the propulsion unit 33.

The propulsion unit 33 has a propeller shaft 40 and a propeller 41. The propeller shaft 40 transmits the rotary force from the interlocking mechanism 38 to the propeller 41. The propulsion unit 33 converts the rotary force generated by the engine 30 into propulsive force.

As shown in FIG. 1, the propeller 41 preferably includes two propellers; a first propeller 41*a* and a second propeller 41*b*. The spiral direction of the first propeller 41*a* and the spiral direction of the second propeller 41*b* are preferably opposite to each other. When the rotary force output from the power transmission mechanism 32 is in the normal rotational direction, the first propeller 41*a* and the second propeller 41*b* rotate in opposite directions and produce forward propulsive force. In this case, the shift position is forward. When the rotary force output from the power transmission mechanism 32 is in the reverse rotational direction, each of the first propeller 41*a* and the second propeller 41*b* rotates in the opposite direction from that in which it rotates when the vessel 1 travels forward. As a result, reverse propulsive force is generated. In this case, the shift position is reverse.

The propeller 41 may be constituted of a single propeller or more than two propellers.

Details of Structure of Shift Mechanism 34

Figure 3:
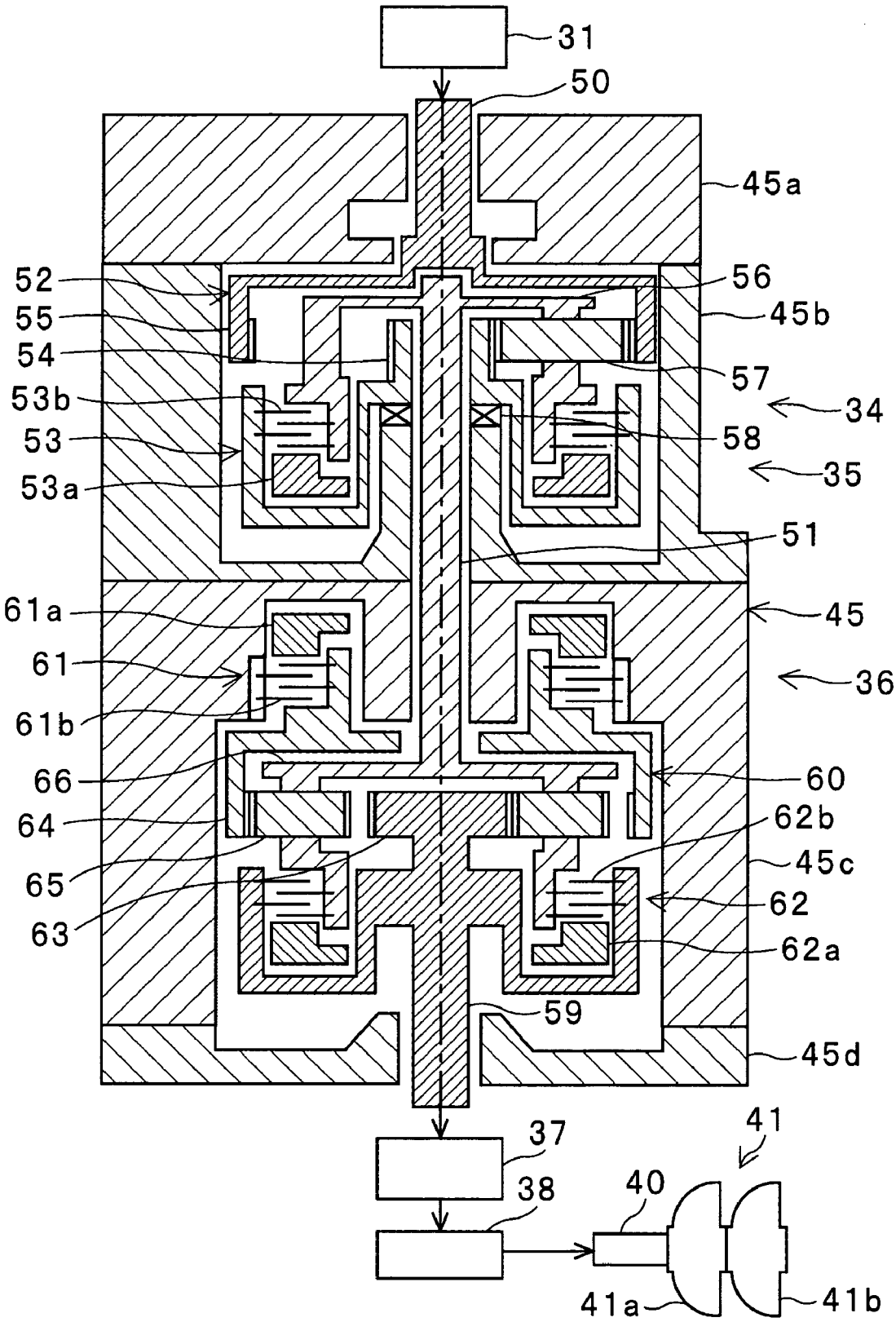
FIG. 3 is a schematic cross-sectional view of a shift mechanism in the first preferred embodiment of the present invention.

Referring primarily to FIG. 3, the structure of the shift mechanism 34 in this preferred embodiment is next described in detail. FIG. 3 schematically illustrates the shift mechanism 34. Thus, the structure of the shift mechanism 34 shown in FIG. 3 is not precisely identical to the actual structure of the shift mechanism 34.

The shift mechanism 34 has a shift case 45. The shift case 45 has a generally cylindrical external shape. The shift case 45 has a first case 45*a*, a second case 45*b*, a third case 45*c*, and a fourth case 45*d*. The first case 45*a*, the second case 45*b*, the third case 45*c*, and the fourth case 45*d* are integrally secured to each other by means of bolts or other fastening members.

Transmission Ratio Switching Mechanism 35

The transmission ratio switching mechanism 35 has a first power-transmitting shaft 50 as an input shaft, a second power-transmitting shaft 51 as an output shaft, the planetary gear mechanism 52 as a speed change gear set, and the transmission ratio switching hydraulic clutch 53.

The planetary gear mechanism 52 transmits the rotation of the first power-transmitting shaft 50 to the second power-transmitting shaft 51 at the low-speed transmission ratio (LOW) or the high-speed transmission ratio (HIGH). The transmission ratio of the planetary gear mechanism 52 is switched by selectively engaging and disengaging the transmission ratio switching hydraulic clutch 53.

The first power-transmitting shaft 50 and the second power-transmitting shaft 51 are disposed coaxially with each other. The first power-transmitting shaft 50 is rotatably supported by the first case 45*a*. The second power-transmitting shaft 51 is rotatably supported by the second case 45*b* and the third case 45*c*. The first power-transmitting shaft 50 is connected to the crankshaft 31. The first power-transmitting shaft 50 is also connected to the planetary gear mechanism 52.

The planetary gear mechanism 52 has a sun gear 54, a ring gear 55, a carrier 56, and a plurality of planetary gears 57. The ring gear 55 has a generally cylindrical shape. The ring gear 55 has teeth formed on its inner periphery which are in meshing engagement with the planetary gears 57. The ring gear 55 is connected to the first power-transmitting shaft 50. The ring gear 55 is rotatable together with the first power-transmitting shaft 50.

The sun gear 54 is located inside the ring gear 55. The sun gear 54 and the ring gear 55 rotate coaxially with each other. The sun gear 54 is attached to the second case 45*b* via a one-way clutch 58. The one-way clutch 58 permits rotation in the normal rotational direction but prevents rotation in the reverse rotational direction. Thus, the sun gear 54 is rotatable in the normal rotational direction but not in the reverse rotational direction.

The planetary gears 57 are located between the sun gear 54 and the ring gear 55. Each of the planetary gears 57 is in meshing engagement with both the sun gear 54 and the ring gear 55. Each of the planetary gears 57 is rotatably supported by the carrier 56. Thus, the planetary gears 57 revolve about the axis of the first power-transmitting shaft 50 at the same speed while rotating about their own axes.

In this specification, the term "rotate" means for a member to rotate about an axis lying inside of it, and the term "revolve" means for a member to travel about an axis lying outside of it.

The carrier 56 is connected to the second power-transmitting shaft 51. The carrier 56 is rotatable together with the second power-transmitting shaft 51.

The transmission ratio switching hydraulic clutch 53 is located between the carrier 56 and the sun gear 54. In this preferred embodiment, the transmission ratio switching hydraulic clutch 53 preferably is a wet multi-plate clutch. In the present invention, however, the transmission ratio switching hydraulic clutch 53 is not limited to a wet multi-plate clutch. The transmission ratio switching hydraulic clutch 53 may be a dry multi-plate clutch or may be a dry single-plate clutch, or what is called a dog clutch, for example.

In this specification, the term "multi-plate clutch" means a clutch having a first member and a second member rotatable relative to each other, one or a plurality of first plates rotatable together with the first member, and one or a plurality of second plates rotatable together with the second member, in which the rotation of the first member and the second member is prevented when the first plate(s) and the second plate(s) are pressed against each other. In this specification, the term "clutch" is not limited to a component disposed between an input shaft into which rotary force is input and an output shaft from which rotary force is output for engaging and disengaging the input shaft and the output shaft.

The transmission ratio switching hydraulic clutch 53 preferably includes a hydraulic cylinder 53*a*, and a plate set 53*b* including at least one clutch plate and at least one friction plate. When the cylinder 53*a* is driven, the plate set 53*b* is brought into a compressed state. Thus, the transmission ratio switching hydraulic clutch 53 is brought into an engaged state. When the cylinder 53*a* is not being driven, the plate set 53*b* is in uncompressed state. Thus, the transmission ratio switching hydraulic clutch 53 is in a disengaged state.

When the transmission ratio switching hydraulic clutch 53 is in the engaged state, the sun gear 54 and the carrier 56 are fixed to each other. Thus, when the planetary gears 57 rotate, the sun gear 54 and the carrier 56 rotate together.

Shift Position Switching Mechanism 36

The shift position switching mechanism 36 is switchable among three shift positions: forward, reverse, and neutral.

In this specification, the term "neutral" means a shift position in which the rotary force of the input shaft of the shift position switching mechanism 36 is not substantially transmitted to the output shaft of the shift position switching mechanism 36. The term "forward" means a shift position in which the rotary force of the input shaft of the shift position switching mechanism 36 is transmitted to the output shaft of the shift position switching mechanism 36, thereby rotating the output shaft of the shift position switching mechanism 36 in the forward direction. The term "reverse" means a shift position in which the rotary force of the input shaft of the shift position switching mechanism 36 is transmitted to the output shaft of the shift position switching mechanism 36, thereby rotating the output shaft of the shift position switching mechanism 36 in the reverse direction. When the shift position switching mechanism 36 is in "forward" or "reverse", the rotational speed of the output shaft of the shift position switching mechanism 36 may be the same as the rotational speed of the input shaft of the shift position switching mechanism 36. When the shift position switching mechanism 36 is in "forward" or "reverse", the rotational speed of the output shaft of the shift position switching mechanism 36 may be lower than the rotational speed of the input shaft of the shift position switching mechanism 36.

The shift position switching mechanism 36 has the second power-transmitting shaft 51 as an input shaft, the third power-transmitting shaft 59 as an output shaft, the planetary gear mechanism 60 as a rotational direction switching mechanism, the second shift switching hydraulic clutch 61, and the first shift switching hydraulic clutch 62.

The planetary gear mechanism 52 switches the direction of rotation of the third power-transmitting shaft 59 with respect to the direction of rotation of the second power-transmitting shaft 51. Specifically, the planetary gear mechanism 52 transmits the rotary force of the second power-transmitting shaft 51 to the third power-transmitting shaft 59 as rotary force in the normal or reverse rotational direction. The rotational direction of the rotary force transmitted by the planetary gear mechanism 52 is switched by selectively engaging and disengaging the second shift switching hydraulic clutch 61 and the first shift switching hydraulic clutch 62.

The third power-transmitting shaft 59 is rotatably supported by the third case 45*c* and the fourth case 45*d*. The second power-transmitting shaft 51 and the third power-transmitting shaft 59 are disposed coaxially with each other. In this preferred embodiment, the shift switching hydraulic clutches 61 and 62 are preferably wet multi-plate clutches. The shift switching hydraulic clutches 61 and 62 may be dry multi-plate clutches or dog clutches, though.

The second power-transmitting shaft 51 is a member shared by the transmission ratio switching mechanism 35 and the shift position switching mechanism 36.

The planetary gear mechanism 60 has a sun gear 63, a ring gear 64, a plurality of planetary gears 65, and a carrier 66.

The carrier 66 is connected to the second power-transmitting shaft 51. The carrier 66 is rotatable together with the second power-transmitting shaft 51. Thus, when the second power-transmitting shaft 51 rotates, the carrier 66 rotates and the planetary gears 65 revolve at the same speed.

The planetary gears 65 mesh with the ring gear 64 and the sun gear 63. The second shift switching hydraulic clutch 61 is located between the ring gear 64 and the third case 45*c*. The second shift switching hydraulic clutch 61 has a hydraulic cylinder 61*a*, and a plate set 61*b* including at least one clutch plate and at least one friction plate. When the hydraulic cylinder 61*a* is driven, the plate set 61*b* is brought into a compressed state. Thus, the second shift switching hydraulic clutch 61 is brought into an engaged state. As a result, the ring gear 64 is fixed relative to the third case 45*c* and becomes incapable of rotating. When the hydraulic cylinder 61*a* is not being driven, the plate set 61*b* is in an uncompressed state. Thus, the second shift switching hydraulic clutch 61 is in a disengaged state. As a result, the ring gear 64 is not stationary but rotatable relative to the third case 45*c*.

The first shift switching hydraulic clutch 62 is located between the carrier 66 and the sun gear 63. The first shift switching hydraulic clutch 62 has a hydraulic cylinder 62*a*, and a plate set 62*b* including at least one clutch plate and at least one friction plate. When the hydraulic cylinder 62*a* is driven, the plate set 62*b* is brought into a compressed state. Thus, the first shift switching hydraulic clutch 62 is brought into an engaged state. As a result, the carrier 66 and the sun gear 63 rotate together. When the hydraulic cylinder 62*a* is not being driven, the plate set 62*b* is in an uncompressed state. Thus, the first shift switching hydraulic clutch 62 is in a disengaged state. As a result, the ring gear 64 and the sun gear 63 are rotatable relative to each other.

As shown in FIG. 2, the shift mechanism 34 is controlled by a control device 91. Specifically, the engagement and disengagement of the transmission ratio switching hydraulic clutch 53, the second shift switching hydraulic clutch 61 and the first shift switching hydraulic clutch 62 are controlled by the control device 91.

The control device 91 has an actuator 70, and an electronic control unit (ECU) 86. The actuator 70 engages and disengages the transmission ratio switching hydraulic clutch 53, the second shift switching hydraulic clutch 61, the first shift switching hydraulic clutch 62. The ECU 86 controls the actuator 70.

Figure 4:
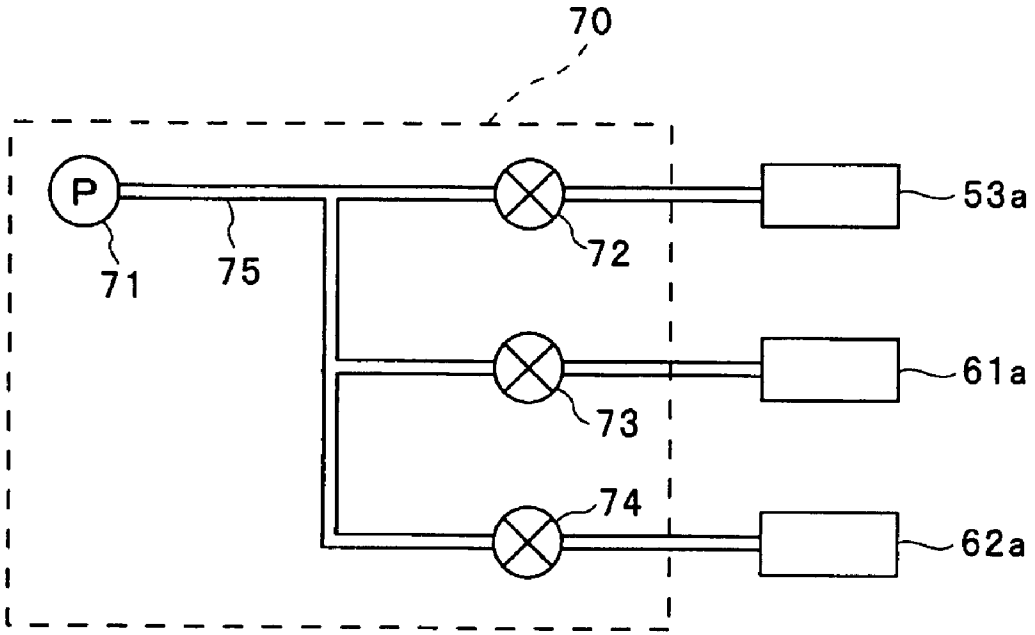
FIG. 4 is an oil circuit diagram in the first preferred embodiment of the present invention.

Specifically, the hydraulic cylinders 53*a*, 61*a*, and 62*a* are driven by the actuator 70 as shown in FIG. 4. The actuator 70 has an oil pump 71, an oil passage 75, a transmission ratio switching electromagnetic valve 72, a reverse shift connecting electromagnetic valve 73, and a forward shift connecting electromagnetic valve 74.

The oil pump 71 is connected to the hydraulic cylinders 53*a*, 61*a*, and 62*a* by the oil passage 75. The transmission ratio switching electromagnetic valve 72 is located between the oil pump 71 and the hydraulic cylinder 53*a*. The hydraulic pressure in the hydraulic cylinder 53*a* is adjusted by the transmission ratio switching electromagnetic valve 72. The reverse shift connecting electromagnetic valve 73 is located between the oil pump 71 and the hydraulic cylinder 61*a*. The hydraulic pressure in the hydraulic cylinder 61*a* is adjusted by the reverse shift connecting electromagnetic valve 73. The forward shift connecting electromagnetic valve 74 is located between the oil pump 71 and the hydraulic cylinder 62*a*. The hydraulic pressure in the hydraulic cylinder 62*a* is adjusted by the forward shift connecting electromagnetic valve 74.

Each of the transmission ratio switching electromagnetic valve 72, the reverse shift connecting electromagnetic valve 73, and the forward shift connecting electromagnetic valve 74 is capable of gradually changing the cross-sectional passage area of the oil passage 75. Thus, by using the transmission ratio switching electromagnetic valve 72, the reverse shift connecting electromagnetic valve 73, and the forward shift connecting electromagnetic valve 74, the pressing forces of the hydraulic cylinders 53*a*, 61*a*, and 62*a* can be gradually changed. Therefore, the engaging forces of the hydraulic clutches 53, 61, and 62 can be gradually changed. Thus, the ratio of the rotational speed of the third power-transmitting shaft 59 to the rotational speed of the second power-transmitting shaft 51 can be adjusted. As s result, the ratio of the rotational speed of the third power-transmitting shaft 59 as the output shaft to the rotational speed of the first power-transmitting shaft 50 as the input shaft can be adjusted substantially and continuously.

The engaging force of a clutch means a value representing the engagement state of the clutch. For example, the expression "the engaging force of the transmission ratio switching hydraulic clutch 53 is 100%" means the state in which the hydraulic cylinder 53*a* has been driven to bring the plate set 53*b* into a completely compressed state and the transmission ratio switching hydraulic clutch 53 is therefore in the completely engaged state. On the other hand, for example, the expression "the engaging force of the transmission ratio switching hydraulic clutch 53 is 0%" means the state in which the hydraulic cylinder 53*a* is not being driven and the plates of the plate set 53*b* have been separated into an uncompressed state until the transmission ratio switching hydraulic clutch 53 are completely disengaged. Also, for example, the expression "the engaging force of the transmission ratio switching hydraulic clutch 53 is 80%" means the state in which the transmission ratio switching hydraulic clutch 53 is engaged such that the driving torque transmitted from the first power-transmitting shaft 50 as an input shaft to the second power-transmitting shaft 51 as an output shaft or the rotational speed of the second power-transmitting shaft 51 is 80% of that which can be achieved when the transmission ratio switching hydraulic clutch 53 has been driven to bring the plate set 53*b* into a completely compressed state and the transmission ratio switching hydraulic clutch 53 is therefore in the completely engaged state, in other words, the transmission ratio switching hydraulic clutch 53 is in a partially engaged position.

In this preferred embodiment, each of the transmission ratio switching electromagnetic valve 72, the reverse shift connecting electromagnetic valve 73, and the forward shift connecting electromagnetic valve 74 is preferably constituted of a PWM (Pulse Width Modulation) controlled solenoid valve, for example. Each of the transmission ratio switching electromagnetic valve 72, the reverse shift connecting electromagnetic valve 73, and the forward shift connecting electromagnetic valve 74 may be constituted of a valve other than a PWM controlled solenoid valve, though. For example, each of the transmission ratio switching electromagnetic valve 72, the reverse shift connecting electromagnetic valve 73, and the forward shift connecting electromagnetic valve 74 may be constituted of an on-off controlled solenoid valve.

Transmission Ratio Changing Operation of Shift Mechanism 34

Referring primarily to FIG. 3 and FIG. 6, the transmission ratio changing operation of the shift mechanism 34 is next described in detail. FIG. 6 is a table showing the engagement states of the hydraulic clutches 53, 61, and 62 and the shift positions of the shift mechanism 34. In the shift mechanism 34, the shift position is switched by selectively engaging and disengaging the first to third hydraulic clutches 53, 61, and 62.

Switching Between Low-Speed Transmission Ratio and High-Speed Transmission Ratio The switching between the low-speed transmission ratio and the high-speed transmission ratio is accomplished by the transmission ratio switching mechanism 35. Specifically, the low-speed transmission ratio and the high-speed transmission ratio are switched by operation of the transmission ratio switching hydraulic clutch 53. More specifically, when the transmission ratio switching hydraulic clutch 53 is disengaged, the "low-speed transmission ratio" is produced. When the transmission ratio switching hydraulic clutch 53 is engaged, the "high-speed transmission ratio" is produced.

As shown in FIG. 3, the ring gear 55 is connected to the first power-transmitting shaft 50. Thus, when the first power-transmitting shaft 50 rotates, the ring gear 55 rotates in the normal rotational direction. Here, when the transmission ratio switching hydraulic clutch 53 is in the disengaged state, the carrier 56 and the sun gear 54 are rotatable relative to each other. Thus, the planetary gears 57 rotate and revolve. As a result, the sun gear 54 is urged to rotate in the reverse rotational direction.

However, as shown in FIG. 6, the one-way clutch 58 prevents the sun gear 54 from rotating in the reverse rotational direction. Thus, the sun gear 54 is held stationary by the one-way clutch 58. As a result, the rotation of the ring gear 55 causes the planetary gears 57 to revolve between the sun gear 54 and the ring gear 55, causing the second power-transmitting shaft 51 to rotate together with the carrier 56. In this case, the planetary gears 57 both revolve and rotate, the rotation of the first power-transmitting shaft 50 is transmitted at a reduced speed to the second power-transmitting shaft 51. That is, the "low-speed transmission ratio" is produced.

When the transmission ratio switching hydraulic clutch 53 is in the engaged state, the planetary gears 57 and the sun gear 54 rotate together. Thus, the rotation of the planetary gears 57 is prevented. Therefore, the rotation of the ring gear 55 causes the planetary gears 57, the carrier 56, and the sun gear 54 to rotate in the normal rotational direction at the same rotational speed as the ring gear 55. Here, as shown in FIG. 6, the one-way clutch 58 permits the sun gear 54 to rotate in the normal rotational direction. As a result, the first power-transmitting shaft 50 and the second power-transmitting shaft 51 rotate in the normal rotational direction at the same rotational speed. In other words, the rotary force of the first power-transmitting shaft 50 is transmitted at the same rotational speed and in the same rotational direction to the second power-transmitting shaft 51. That is, the "high-speed transmission ratio" is produced.

Switching Among Forward, Reverse, and Neutral

The switching among forward, reverse, and neutral is accomplished by the shift position switching mechanism 36. Specifically, the switching among forward, reverse, and neutral is accomplished by operation of the second shift switching hydraulic clutch 61 and the first shift switching hydraulic clutch 62.

When the second shift switching hydraulic clutch 61 is in the disengaged state and the first shift switching hydraulic clutch 62 is in the engaged state, the "forward" shift position is established. When the second shift switching hydraulic clutch 61 is in the disengaged state, the ring gear 64 is rotatable relative to the shift case 45. When the first shift switching hydraulic clutch 62 is in the engaged state, the carrier 66, the sun gear 63, and the third power-transmitting shaft 59 rotate together. Thus, when the second shift switching hydraulic clutch 61 is in the disengaged state and the first shift switching hydraulic clutch 62 is in the engaged state, the second power-transmitting shaft 51, the carrier 66, the sun gear 63, and the third power-transmitting shaft 59 rotate together in the normal rotational direction. That is, the "forward" shift position is established.

When the second shift switching hydraulic clutch 61 is in the engaged state and the first shift switching hydraulic clutch 62 is in the disengaged state, the "reverse" shift position is established. When the second shift switching hydraulic clutch 61 is in the engaged state and the first shift switching hydraulic clutch 62 is in the disengaged state, the ring gear 64 is prevented from rotating by the shift case 45. On the other hand, the sun gear 63 is rotatable relative to the carrier 66. Thus, when the second power-transmitting shaft 51 rotates in the normal rotational direction, the planetary gears 65 revolve while rotating. As a result, the sun gear 63 and the third power-transmitting shaft 59 rotate in the reverse rotational direction. That is, the "reverse" shift position is established.

When both the second shift switching hydraulic clutch 61 and the first shift switching hydraulic clutch 62 are in the disengaged state, the "neutral" shift position is established. When both the second shift switching hydraulic clutch 61 and the first shift switching hydraulic clutch 62 are in the disengaged state, the planetary gear mechanism 60 rotate idly. Thus, the rotation of the second power-transmitting shaft 51 is not transmitted to the third power-transmitting shaft 59. That is, the "neutral" shift position is established.

The switching between the high-speed transmission ratio and the low-speed transmission ratio and the switching of the shift position are accomplished as described above. Thus, as shown in FIG. 6, when the transmission ratio switching hydraulic clutch 53 and the second shift switching hydraulic clutch 61 are in the disengaged state and the first shift switching hydraulic clutch 62 is in the engaged state, a shift position "low-speed forward" is established. When the transmission ratio switching hydraulic clutch 53 and the first shift switching hydraulic clutch 62 are in the engaged state and the second shift switching hydraulic clutch 61 is in the disengaged state, the shift position "high-speed forward" is established. When both the second shift switching hydraulic clutch 61 and the first shift switching hydraulic clutch 62 are in the disengaged state, a shift position "neutral" is established irrespective of the engagement state of the transmission ratio switching hydraulic clutch 53. When the transmission ratio switching hydraulic clutch 53 and the first shift switching hydraulic clutch 62 are in the disengaged state and the second shift switching hydraulic clutch 61 is in the engaged state, a shift position "low-speed reverse" is established. When the transmission ratio switching hydraulic clutch 53 and the second shift switching hydraulic clutch 61 are in the engaged state and the first shift switching hydraulic clutch 62 is in the disengaged state, a shift position "high-speed reverse" is established.

Control Block of Vessel 1

Referring primarily to FIG. 5, the control block of the vessel 1 is next described.

Referring first to FIG. 5, the control block of the outboard motor 20 is described. The outboard motor 20 is provided with the ECU 86. The ECU 86 constitutes a portion of the control device 91 depicted in FIG. 2. All the mechanisms in the outboard motor 20 preferably are controlled by the ECU 86.

The ECU 86 has a CPU (central processing unit) **86*a* as a computing section and a memory 86*b*. In the memory 86*b*, various settings including the maps described later are stored. The memory 86*b* is connected to the CPU 86*a*. The CPU 86*a* reads out necessary information from the memory 86*b* when it carries out various operations. Also, the CPU 86*a* outputs the results of the operations to the memory 86*b* and stores the results of the operations and so on in the memory 86*b*** as needed.

The throttle body 87 of the engine 30 is connected to the ECU 86. The throttle body 87 is controlled by the ECU 86. The throttle opening of the engine 30 is therefore controlled. Specifically, based on the displacement of a control lever 83 and a sensitivity switching signal, the throttle opening of the engine 30 is controlled. As a result, the output of the engine 30 is controlled.

An engine rotational speed sensor 88 is connected to the ECU 86. The engine rotational speed sensor 88 detects the rotational speed of the crankshaft 31 of the engine 30 shown in FIG. 1. The engine rotational speed sensor 88 outputs the detected value of the engine rotational speed to the ECU 86.

A propeller rotational speed sensor 90 is disposed in the propulsion unit 33. The propeller rotational speed sensor 90 detects the rotational speed of the propeller 41. The propeller rotational speed sensor 90 outputs the detected value of the rotational speed of the propeller 41 to the ECU 86. The rotational speed of the propeller 41 and the rotational speed of the propeller shaft 40 are substantially equal to each other. Thus, the propeller rotational speed sensor 90 may detect the rotational speed of the propeller shaft 40. Therefore, the propeller rotational speed sensor 90 may be located in the casing 27.

The propulsion unit 33 also has a water detecting sensor 93. The water detecting sensor 93 detects whether or not the propulsion unit 33 is positioned in water. The water detecting sensor 93 outputs information on whether or not the propulsion unit 33 is positioned in water to the ECU 86. When the propulsion unit 33 is positioned in water, the water detecting sensor 93 is turned on. In this case, the water detecting sensor 93 outputs an on signal to the ECU 86. When the propulsion unit 33 is not positioned in water, the water detecting sensor 93 is turned off. In this case, the water detecting sensor 93 outputs an off signal to the ECU 86.

A tilt switch 94 is connected to the ECU 86. When the vessel operator operates the tilt switch 94, the outboard motor body 21 is tilted or trimmed by the tilt-trim mechanism 22 shown in FIG. 1. Specifically, when the tilt switch 94 is operated by the operator, the angle of the swivel bracket 25 with respect to the mount bracket 24 is adjusted. The outboard motor body 21 is thereby tilted or trimmed.

The outboard motor 20 has a tilt sensor 19. The angle between the mount bracket 24 and the swivel bracket 25 is detected. The tilt sensor 19 outputs the detected angle between the mount bracket 24 and the swivel bracket 25 to the ECU 86.

The transmission ratio switching electromagnetic valve 72, the forward shift connecting electromagnetic valve 74, and the reverse shift connecting electromagnetic valve 73 are connected to the ECU 86. The opening and closing of the transmission ratio switching electromagnetic valve 72, the forward shift connecting electromagnetic valve 74, and the reverse shift connecting electromagnetic valve 73 and the degrees of the openings of the valves are controlled by the ECU 86.

As shown in FIG. 5, the vessel 1 is provided with a local area network (LAN) 80. The LAN 80 is installed in the whole hull 10. In the vessel 1, signals are transmitted between the devices through the LAN 80.

To the LAN 80 are connected the ECU 86 of the outboard motor 20, the controller 82, a display device 81, and so on. The display device 81 displays the information output from the ECU 86, and the information output from the controller 82, which is described later. Specifically, the display device 81 displays the current speed of the vessel 1, the shift position, and so on.

The controller 82 has a control lever 83, an accelerator operation amount sensor 84, a shift position sensor 85, and a canceling switch 92 for canceling propeller rotational speed reduction control.

The vessel operator of the vessel 1 operates the control lever 83 to input the shift position and the accelerator operation amount. Specifically, when the vessel operator operates the control lever 83, the accelerator operation amount and the shift position corresponding to the displacement and position of the control lever 83 are detected by the accelerator operation amount sensor 84 and the shift position sensor 85, respectively. The accelerator operation amount sensor 84 and the shift position sensor 85 are connected to the LAN 80. The accelerator operation amount sensor 84 and the shift position sensor 85 send an accelerator operation amount signal and a shift position signal, respectively, to the LAN 80. The ECU 86 receives the accelerator operation amount signal and the shift position signal outputted from the accelerator operation amount sensor 84 and the shift position sensor 85, respectively, via the LAN 80.

Specifically, when the control lever 83 is in the neutral range, the shift position sensor 85 outputs a shift position signal corresponding to neutral. When the control lever 83 is in the forward range, the shift position sensor 85 outputs a shift position signal corresponding to forward. When the control lever 83 is in the reverse range, the shift position sensor 85 outputs a shift position signal corresponding to reverse.

The accelerator operation amount sensor 84 detects the displacement of the control lever 83. Specifically, the accelerator operation amount sensor 84 detects an operational angle θ indicating how far the control lever 83 is displaced from the middle position. The control lever 83 outputs the operational angle θ as the accelerator operation amount signal.

The canceling switch 92 shown in FIG. 5 is a switch for switching between a "normal mode" as a first mode in which propeller rotational speed reduction control is performed and a "test operation mode" as a second mode in which propeller rotational speed reduction control is inhibited. The canceling switch 92 outputs the information on whether the selected mode is the "normal mode" or the "test operation mode" to the ECU 86 via the LAN 80.

In this preferred embodiment, the "normal mode" is basically selected when the vessel 1 travels under normal conditions. The "test operation mode" is selected when the outboard motor 20 is tested, for example.

Control of Vessel 1

Control of the vessel 1 is next described.

Basic Control of Vessel 1

When the control lever 83 is operated by the vessel operator of the vessel 1, the accelerator operation amount and the shift position corresponding to the operative condition of the control lever 83 are detected by the accelerator operation amount sensor 84 and the shift position sensor 85, respectively. The detected accelerator operation amount and shift position are transmitted to the LAN 80. The ECU 86 receives the output accelerator operation amount signal and shift position signal via the LAN 80. The ECU 86 controls the throttle body 87 and the hydraulic clutches 53, 61, and 62 based on the accelerator operation amount signal and the shift position signal. The ECU 86 thereby controls the propeller rotational speed and the shift position.

Details of Control of Vessel 1

(1) Propeller Rotational Speed Reduction Control

In this preferred embodiment, if the propeller rotational speed sensor 90 detects a rotational speed of the propeller 41 when the control lever 83 is in the neutral position, the shift mechanism 34 is controlled so as to reduce the rotational speed of the propeller 41. Specifically, when the state in which the control lever 83 is in the neutral position has continued for a predetermined period of time or longer, the shift mechanism 34 is controlled so as to reduce the rotational speed of the propeller 41 while the engine rotational speed is equal to or lower than a predetermined rotational speed and the control lever 83 is in the neutral position. Also, when the outboard motor 20 is in a tilted state, or when the water detecting sensor 93 determines that the propulsion unit 33 is not positioned in water, the shift mechanism 34 is controlled so as to reduce the rotational speed of the propeller 41.

Referring to FIG. 7 to FIG. 10, the propeller rotational speed reduction control in this preferred embodiment is described in further detail.

Figure 7:
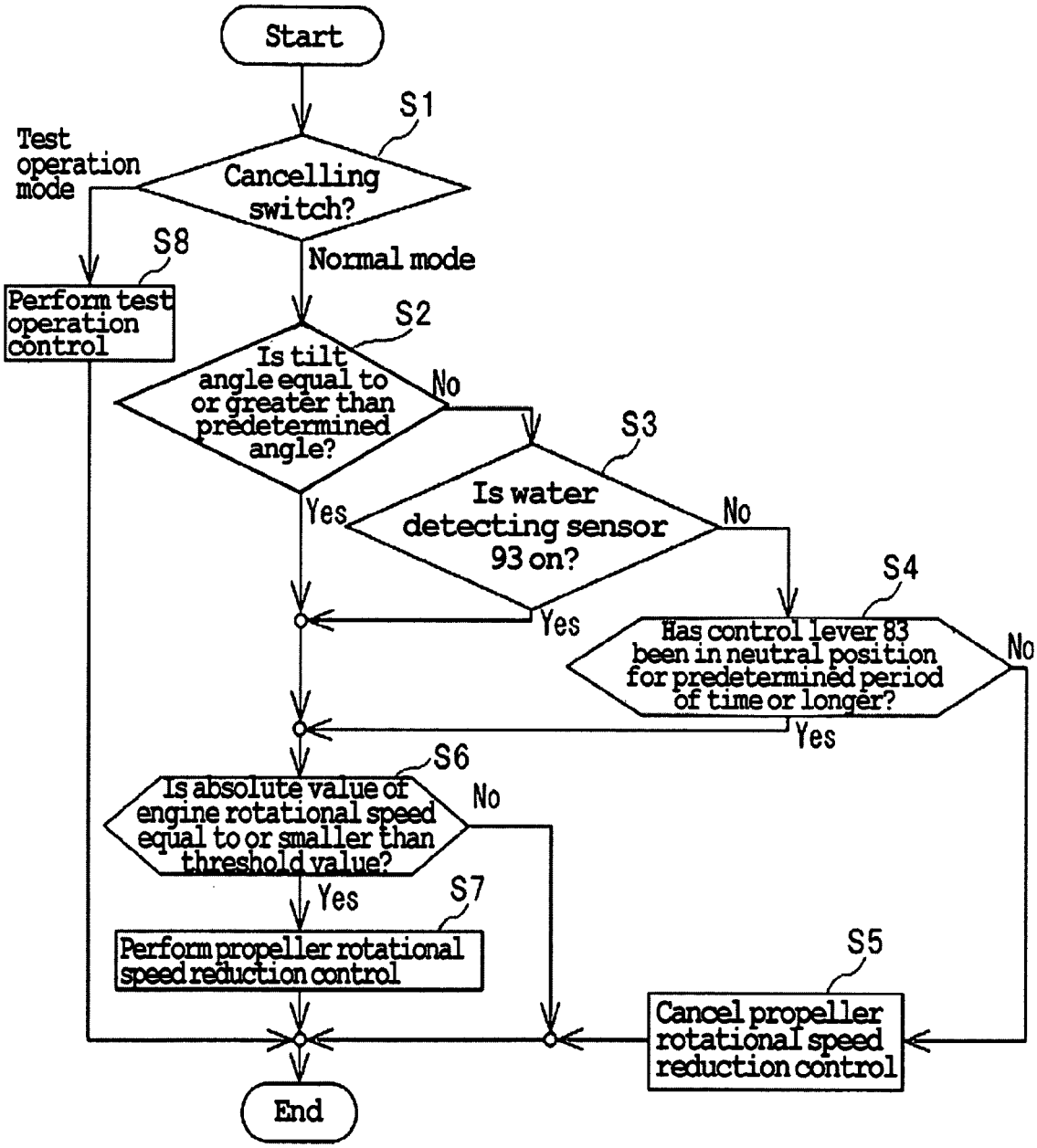
FIG. 7 is a flowchart showing control which is performed when the outboard motor is being driven.

When the outboard motor 20 is being driven, the control shown in FIG. 7 is repeatedly performed every approximately 5 ms to 50 ms, for example. In this control, the ECU 86 first determines the position of the canceling switch 92 in step S1. If the test operation mode has been selected by the canceling switch 92, the process proceeds to step S8.

Figure 8:
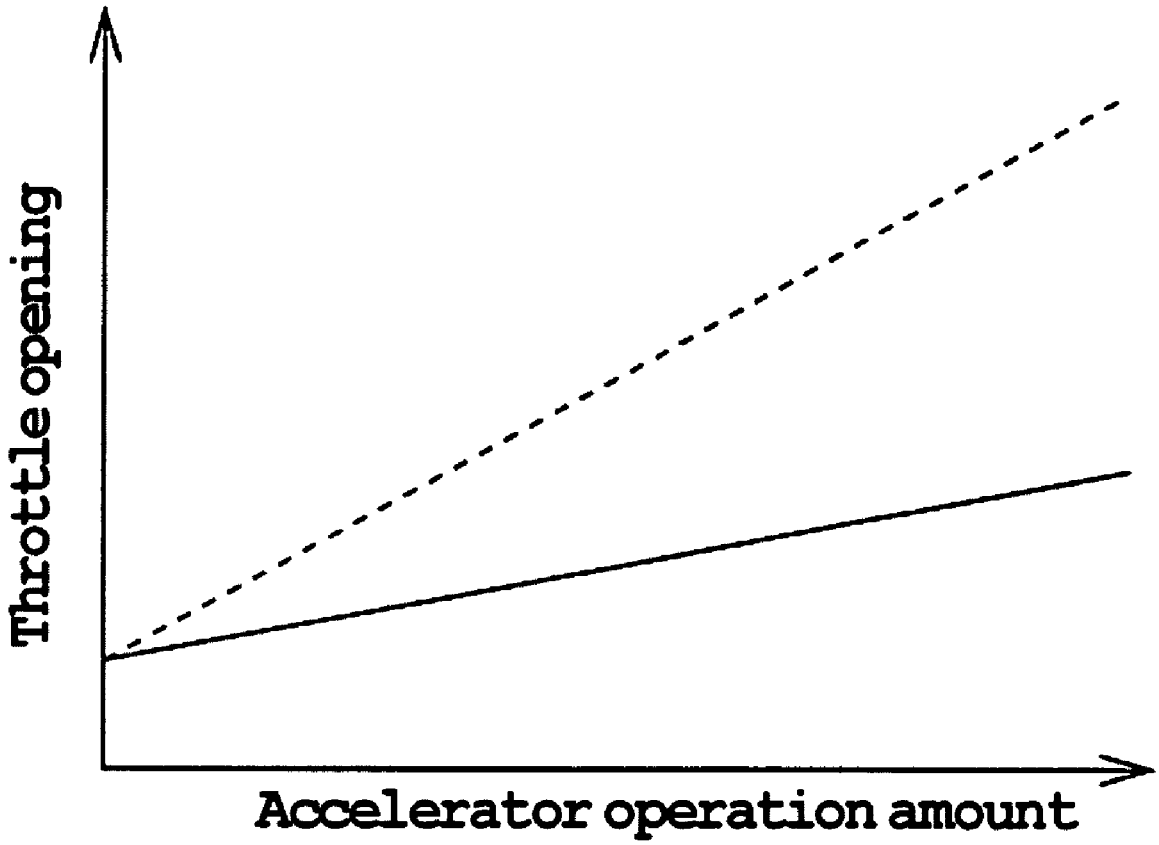
FIG. 8 is a map representing the relationship between the accelerator operation amount and the throttle opening which is consulted during test operation control.
Figure 9:
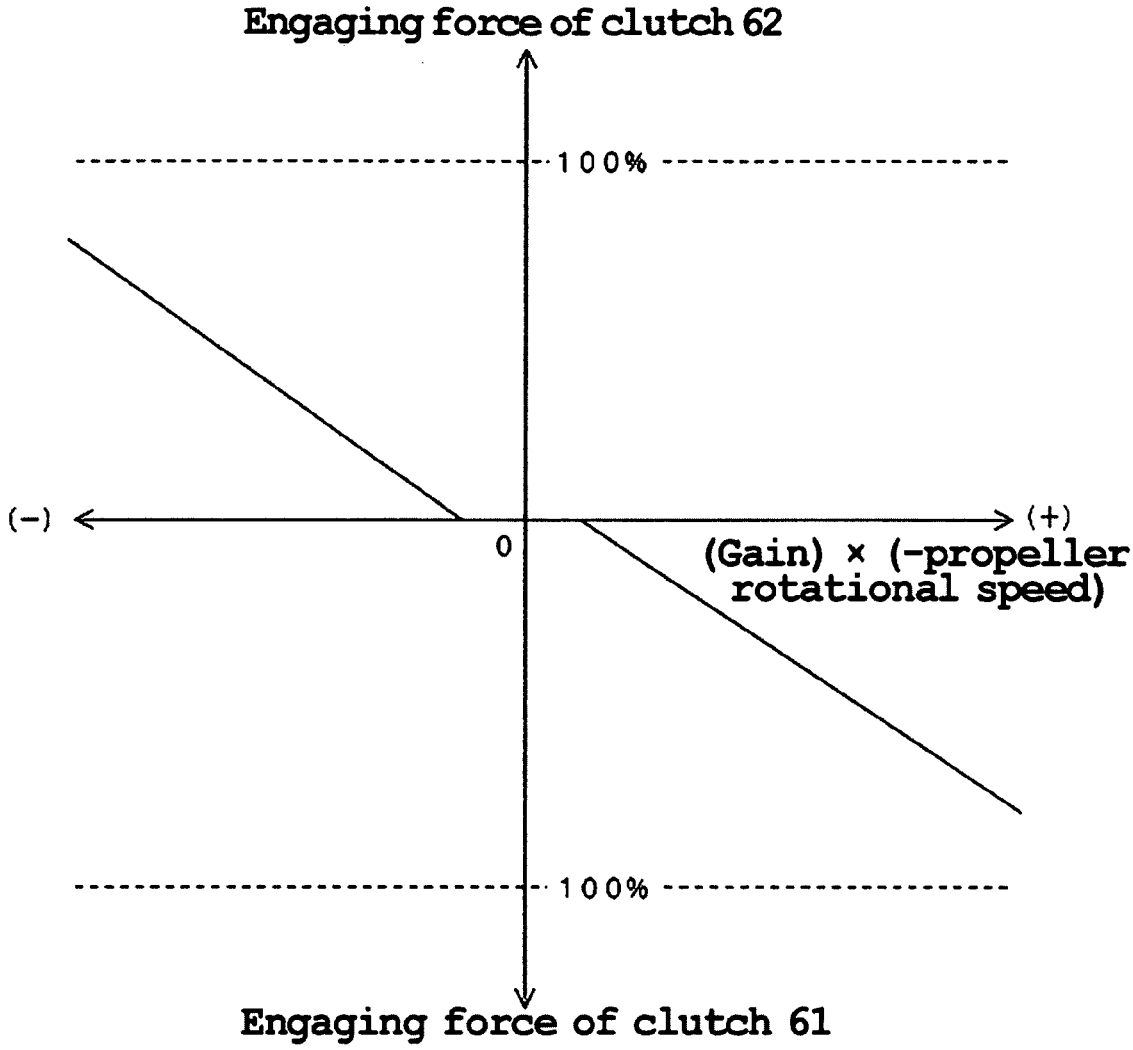
FIG. 9 is a map which defines the relationship between the engaging forces of first and second shift switching hydraulic clutches and {(gain)×(−propeller rotational speed)}.

In step S8, the ECU 86 performs test operation control. In the test operation control, the ECU 86 controls the engine 30 based on a map shown in FIG. 8. Specifically, the map shown in FIG. 8 is stored in the memory 86*b* shown in FIG. 5. The CPU 86*a* reads out the map shown in FIG. 8 from the memory 86*b* in step S8. The CPU 86*a* controls the throttle opening according to the solid line in the map shown in FIG. 8. Here, the broken line in the map shown in FIG. 8 is the line which is used as a reference when the throttle opening is controlled in the normal mode. In the map shown in FIG. 8, the throttle opening determined by the solid line is smaller than that determined by the broken line. Thus, in the test operation control in step S8, the throttle opening is controlled to be smaller than in the normal mode. Therefore, in the test operation control in step S8, the engine rotational speed is controlled to be lower than that in the normal mode.

If the normal mode has been selected by the canceling switch 92, the process proceeds to step S2.

In step S2, the ECU 86 determines whether or not the tilt angle is equal to or greater than a predetermined angle. Here, the "tilt angle" is the angle between the mount bracket 24 and the swivel bracket 25. If it is determined in step S2 that the tilt angle is smaller than the predetermined angle, the process proceeds to step S6. If it is determined that the tilt angle is equal to or greater than the predetermined angle, the process proceeds to step S3.

The "predetermined angle" in step S2 may be set as appropriate depending on the features of the outboard motor 20 and so on. The "predetermined angle" in step S2 may be set to an angle at which the propeller 41 is considered to be exposed above water. Specifically, the "predetermined angle" in step S2 may be equal to or greater than 50°, for example.

The ECU 86 determines whether or not the tilt switch 94 is on.

In step S3, the ECU 86 determines whether or not the water detecting sensor 93 is on. If the water detecting sensor 93 is on because the propulsion unit 33 is positioned in water, the process proceeds to step S6. If the water detecting sensor 93 is off because the propulsion unit 33 is not positioned in water, the process proceeds to step S4.

In step S4, the ECU 86 determines whether or not the control lever 83 has been in the neutral position corresponding to neutral for a predetermined period of time or longer. The "predetermined period of time" in step S4 may be set as appropriate depending on the features of the outboard motor 20. The "predetermined period of time" in step S4 may be set to about 0.1 seconds to about 10 seconds, for example. For example, the "predetermined period of time" may be set to about 1 second.

If it is determined in step S4 that the control lever 83 has been in the neutral position for the predetermined period of time or longer, the process proceeds to step S6. If it is determined that the control lever 83 has not been in the neutral position for the predetermined period of time or longer, the process proceeds to step S5.

In step S5, the propeller rotational speed reduction control is cancelled. Specifically, when the propeller rotational speed reduction control is in progress, the ECU 86 cancels the propeller rotational speed reduction control. When the propeller rotational speed reduction control is not in progress, nothing is done.

In step S6, the ECU 86 determines whether or not the absolute value of the engine rotational speed is equal to or smaller than a predetermined threshold value. If it is determined in step S6 that the absolute value of the engine rotational speed is equal to or smaller than the predetermined threshold value, the process proceeds to step S7. If it is determined that the absolute value of the engine rotational speed is greater than the predetermined threshold value, step S7 is not performed. The "threshold value" in step S6 may be set as appropriate depending on the features of the outboard motor 20 and so on. The "threshold value" in step S6 may be set to about 300 rpm to about 2,000 rpm, for example.

In step S7, the ECU 86 performs propeller rotational speed reduction control. More specifically, the ECU 86 controls the shift mechanism 34 to a shift position in which rotary torque in a direction opposite the direction in which the propeller 41 is rotating is applied to the propeller 41. Specifically, the ECU 86 changes the engaging forces of the shift switching hydraulic clutches 61 and 62 with the shift connecting electromagnetic valves 73 and 74 to control the shift mechanism 34 to a shift position in which rotary torque in a direction opposite the direction in which the propeller 41 is rotating is applied to the propeller 41.

The propeller rotational speed reduction control in this preferred embodiment is next described. First, the CPU 86*a* acquires the rotational speed of the propeller 41 from the propeller rotational speed sensor 90. The CPU 86*a* multiplies the value obtained by subtracting the acquired value of the propeller rotational speed from 0 by a gain. The CPU 86*a* reads out a map shown in FIG. 9 from the memory 86*b*. The CPU 86*a* calculates target values for the engaging forces of the first shift switching hydraulic clutch 62 and the second shift switching hydraulic clutch 61 by inputting (gain)×(−propeller rotational speed) into the map shown in FIG. 9. Then, the CPU 86*a* causes the actuator 70 to change the engaging forces of the first shift switching hydraulic clutch 62 and the second shift switching hydraulic clutch 61 to the calculated engaging forces.

In the propeller rotational speed reduction control in this preferred embodiment, the control gain described above is not particularly limited. The control gain may be selected from a proportional gain, a differential gain, an integral gain, and so on in view of hydraulic pressure response, mechanical inertia force, and so on. The control gain may be a combination of a proportional gain, a differential gain, an integral gain, and so on. For example, a control gain obtained by combining a proportional gain and an integral gain may be used.

Figure 10:
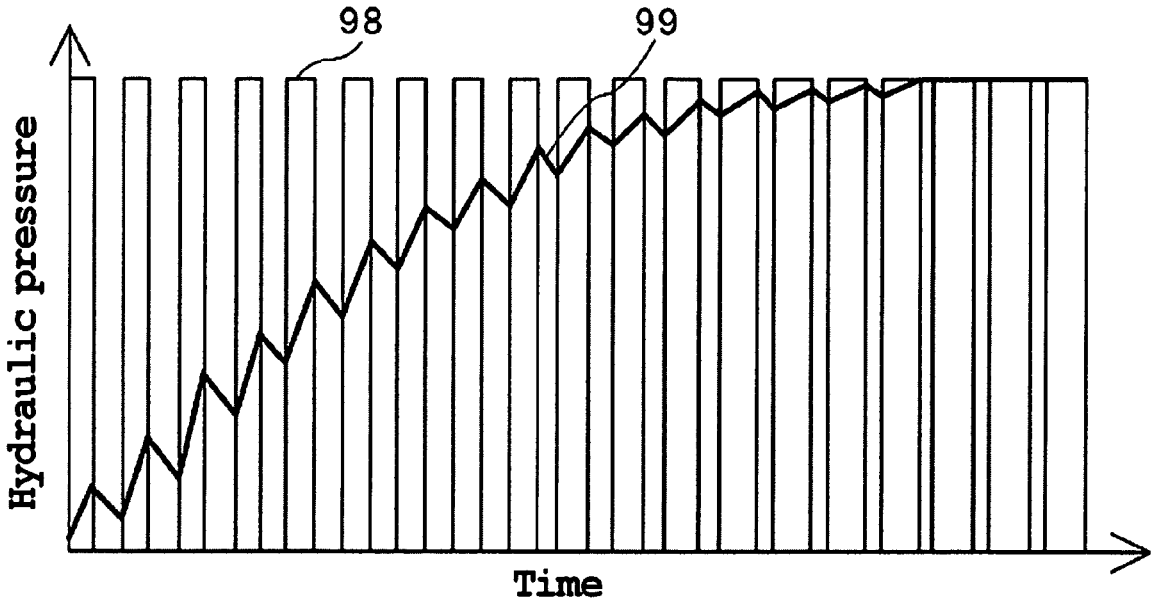
FIG. 10 is a graph representing the hydraulic pressure which is supplied to a corresponding valve when the engaging force of a hydraulic clutch is increased.

In this preferred embodiment, when the engaging force of the shift switching hydraulic clutch 61 or 62 is increased, the hydraulic pressure to the shift connecting electromagnetic valve 73 or 74 is gradually increased as shown in FIG. 10. As a result, the engaging force of the shift switching hydraulic clutch 61 or 62 is gradually increased. The lines identified as "98" in FIG. 10 represent PWM signals which are output to the shift connecting electromagnetic valve 73 or 74. The curve identified as "99" in FIG. 10 represents the hydraulic pressure to the shift connecting electromagnetic valve 73 or 74.

As described above, in this preferred embodiment, if the propeller rotational speed sensor 90 detects a rotational speed of the propeller 41 when the control lever 83 is in the neutral position, the shift mechanism 34 is controlled so as to reduce the rotational speed of the propeller 41. Thus, the rotation of the propeller 41 can be restricted when the control lever 83 is in the neutral position.

Especially, in this preferred embodiment, the rotation of the propeller 41 is restricted by applying rotary torque in a direction opposite the direction in which the propeller 41 is rotating to the propeller 41. Thus, the rotation of the propeller 41 can be restricted more quickly. Also, the rotational speed of the propeller 41 can be maintained within a narrower range.

Also, in this preferred embodiment, the magnitudes of the hydraulic pressures to be supplied to the valves 73 and 74 can be gradually changed. In other words, the hydraulic pressures to be supplied to the valves 73 and 74 can be of any desired magnitude. Thus, the rotational speed of the propeller 41 can be maintained within a very narrow range.

Modifications 1 and 2

In the above preferred embodiment, an example in which the propeller rotational speed reduction control is achieved preferably by controlling the shift mechanism 34. In the present invention, however, the propeller rotational speed reduction control may not be necessarily achieved by controlling the shift mechanism 34 alone. For example, the propeller rotational speed reduction control may be achieved by controlling the shift mechanism 34 and controlling the output of the engine 30. In this case, the rotation of the propeller 41 can be restricted more effectively when the control lever 83 is in the neutral position.

Also, the propeller rotational speed reduction control may be achieved by controlling the output of the engine 30 without controlling the shift mechanism 34, for example. In this case again, the rotation of the propeller 41 can be restricted when the propeller rotational speed sensor 90 detects a rotational speed of the propeller 41 and the control lever 83 is in the neutral position.

In this preferred embodiment, the shift mechanism 34 is also controlled so as to reduce the rotational speed of the propeller 41 if the propeller rotational speed sensor 90 detects a rotational speed of the propeller 41 when the tilt angle is equal to or greater than a predetermined angle. Thus, when the propeller 41 does not substantially contribute to propulsion, such as when the propeller 41 is exposed above water, the rotation of the propeller 41 is restricted.

Other Modifications

In the above preferred embodiments, a map for use in controlling the transmission ratio switching mechanism 35 and a map for use in controlling the shift position switching mechanism 36 are preferably stored in the memory 86*b* in the ECU 86 mounted in the outboard motor 20. Also, control signals for use in controlling the electromagnetic valves 72, 73, and 74 are preferably output from the CPU 86*a* in the ECU 86 mounted in the outboard motor 20.

However, the present invention is not limited the configuration. For example, the controller 82 mounted on the hull 10 may be provided with a memory as a storage section and a CPU as a computing section in addition to or instead of the memory 86*b* and the CPU 86*a* can be provided. In this case, at least one of the map for use in controlling the transmission ratio switching mechanism 35 and the map for use in controlling the shift position switching mechanism 36 may be stored in the memory provided in the controller 82. Also, the control signals for use in controlling the electromagnetic valves 72, 73, and 74 may be output from the CPU provided in the controller 82.

In the above preferred embodiments, an example in which the ECU 86 controls both the engine 30 and the electromagnetic valves 72, 73, and 74 is described. However, the present invention is not limited the configuration. For example, an ECU for controlling the engine and an ECU for controlling the electromagnetic valves may be provided separately.

In the above preferred embodiments, an example in which the controller 82 is what is called an "electronically-controlled controller" is described. Here, the term "electronically-controlled controller" means a controller which converts the displacement of the control lever 83 into an electric signal and outputs the electric signal to the LAN 80.

In the present invention, however, the controller 82 may not be an electronically-controlled controller. The controller 82 may be what is called a mechanical controller, for example.

Here, the term "mechanical controller" means a controller which has a control lever and a wire connected to the control lever, and transmits the displacement and the direction of displacement of the control lever to the outboard motor as physical quantities, the displacement and the direction of displacement of the wire.

In the above preferred embodiments, an example in which the shift mechanism 34 has the transmission ratio switching mechanism 35 is described. However, the shift mechanism 34 may not have the transmission ratio switching mechanism 35. For example, the shift mechanism 34 may have only the shift position switching mechanism 36.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A marine propulsion system comprising:

a power source;

a propeller driven by the power source;

a shift mechanism located between the power source and the propeller, and switchable among three shift positions including forward, neutral, and reverse;

a control lever operable by a vessel operator to switch the shift position of the shift mechanism;

a rotational speed sensor to detect a rotational speed of the propeller; and a control device to control at least one of the power source and the shift mechanism so as to reduce the rotational speed of the propeller if the rotational speed sensor detects a rotation of the propeller when the control lever is in a position corresponding to the neutral shift position.

2. The marine propulsion system according to claim 1, wherein the control device controls the shift mechanism to a shift position in which rotary torque in a direction opposite the direction in which the propeller is rotating is applied to the propeller if the rotational speed sensor detects a rotation of the propeller when the control lever is in a position corresponding to the neutral shift position.

3. The marine propulsion system according to claim 1, wherein the shift mechanism includes a first clutch which is engaged when the shift mechanism is in the forward shift position and is disengaged when the shift mechanism is in the reverse or neutral shift position, and a second clutch which is engaged when the shift mechanism is in the reverse shift position and is disengaged when the shift mechanism is in the forward or neutral shift position, wherein the control device controls engaging forces of the first and second clutches so that rotary torque in a direction opposite the direction in which the propeller is rotating is applied to the propeller if the rotational speed sensor detects a rotation of the propeller when the control lever is in a position corresponding to the neutral shift position.

4. The marine propulsion system according to claim 3, wherein each of the first and second clutches is a multi-plate clutch.

5. The marine propulsion system according to claim 4, wherein the control device includes an oil pump to pump oil and thereby generate hydraulic pressure necessary to engage and disengage the first and second clutches, a first valve located between the oil pump and the first clutch to open and close communication of the oil between the oil pump and the first clutch, a second valve located between the oil pump and the second clutch to open and close communication of the oil between the oil pump and the second clutch, and a control unit to drive the first valve and the second valve.

6. The marine propulsion system according to claim 5, wherein each of the first and second valves gradually changes an amount of the oil passing therethrough to gradually change a magnitude of the hydraulic pressure which is supplied to the corresponding clutch.

7. The marine propulsion system according to claim 1, wherein the control device reduces an output of the power source if the rotational speed sensor detects rotation of the propeller when the control lever is in a position corresponding to the neutral shift position.

8. The marine propulsion system according to claim 1, further comprising a switch to switch between a first mode to cause the control device to perform control to reduce the rotational speed of the propeller if the rotational speed sensor detects a rotation of the propeller when the control lever is in a position corresponding to the neutral shift position and a second mode to prevent the control device from performing the control.

9. The marine propulsion system according to claim 1, further comprising:

a mount bracket secured to a hull;

a swivel bracket which is supported by the mount bracket for vertical swinging movement about a pivot axis and to which a propulsion system body including at least the power source, the propeller, and the shift mechanism is attached;

a tilt mechanism disposed between the mount bracket and the swivel bracket to swing the swivel bracket relative to the mount bracket; and a tilt sensor to detect an angle between the mount bracket and the swivel bracket; wherein the control device controls at least one of the power source and the shift mechanism so as to reduce the rotational speed of the propeller if the rotational speed sensor detects a rotation of the propeller when the angle between the mount bracket and the swivel bracket detected by the tilt sensor is equal to or greater than a predetermined angle.

* * * * *